US006871756B1

(12) United States Patent
Gallo

(10) Patent No.: US 6,871,756 B1
(45) Date of Patent: Mar. 29, 2005

(54) METHOD AND APPARATUS FOR THE CONVERSION OF BEVERAGE VENDING MACHINE

(76) Inventor: Ralph Gallo, 405 Grant St., East Rocheater, NY (US) 14445

( * ) Notice: Subject to any disclaimer, the term of this patent is extended or adjusted under 35 U.S.C. 154(b) by 177 days.

(21) Appl. No.: 10/155,430

(22) Filed: May 24, 2002

(51) Int. Cl.[7] ..... G07F 11/00
(52) U.S. Cl. ..... 221/75; 221/124
(58) Field of Search ..... 221/67, 2, 7, 9, 221/241, 289, 265, 266; 312/42, 45, 73; 211/59.2, 59.1

(56) References Cited

U.S. PATENT DOCUMENTS

| | | | | |
|---|---|---|---|---|
| 4,509,658 A | * | 4/1985 | Oden | 221/115 |
| 4,986,615 A | * | 1/1991 | Hieb et al. | 312/45 |
| 5,176,288 A | * | 1/1993 | Craven | 221/124 |
| 5,996,838 A | * | 12/1999 | Bayer et al. | 221/75 |
| 6,155,455 A | * | 12/2000 | Yajima et al. | 221/97 |

OTHER PUBLICATIONS

Dixie–Narco, Inc., A Maytag Company, "Parts List Most Ranson Built Models Made during the 1980's, DNCB–1 1/4" 2569CG thru 3097AN," DNCB–T 2497AG thru 3100AN, Dixie–Narco, Inc., A Maytag Company (Williston, S.C.), (Dec. 1, 1997).

* cited by examiner

*Primary Examiner*—Kenneth Noland
(74) *Attorney, Agent, or Firm*—Basch & Nickerson LLP; Duane C. Basch

(57) ABSTRACT

The present invention is a method and apparatus a method and apparatus for the refurbishment of a beverage vending machine to enable a can vending machine to be reconfigured for the dispensing of bottles. In particular, the apparatus and process are directed to the modification of certain components of a can vending machine to enable it to be utilized for dispensing of newer, 16- or 20-ounce beverage bottles. The modification includes a change in the spacing and configuration of the container storage rack and the modification of dispensing mechanisms to allow a can-type system to dispense bottles and thereby avoid the need to completely replace the vending machine.

16 Claims, 10 Drawing Sheets

METHOD AND APPARATUS FOR THE CONVERSION OF BEVERAGE VENDING MACHINE

This invention relates generally to modification of a vending machine, and more particularly to the conversion of a traditional 12-ounce can vending machine to enable the machine to be used for the vending of 16- or 20-ounce bottles.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND AND SUMMARY OF THE INVENTION

The present invention is directed to a method and an associated apparatus that enables the conversion or reconditioning of an existing vending machine to handle items contained in alternatively sized packages. More specifically, the invention relates to the conversion of a can-type beverage vending machine to enable the machine to dispense newer bottled beverages.

As is well known in the vending industry, vending machines, and particularly beverage vending machines, must dispense the product that is desired and available from distributors in order to sell product. Hence, when newer packaging such as 16- or 20-ounce bottles is made available for beverage vending machines, customers of vending equipment expect to be able to purchase such products. However, it is generally the case that in order to provide for the sale of the newer packaged products, the machines used to dispense predecessor products (e.g. 12-ounce cans) must be replaced. Moreover, the replacement of the older style machines, while still functional, results in numerous older machines needing to be recycled and scrapped. The recycling and scrapping of such machines is also not without cost as there are components (e.g., refrigerants) that must be properly recovered and disposed of before the machines can be scrapped for the metal.

Realizing the opportunity to utilize fully functional, yet obsolete, vending machines, the present invention is directed to a method and apparatus that enables beverage can dispensing machines (e.g., 12-ounce cans) to be reconditioned, with only few reworked components, and placed in service for the dispensing of 16- or 20-ounce bottled beverages. It is believed that the present invention is a cost-effective manner of dealing with functional machines that will be displaced by newer machines, or a way for some vending machine owners to upgrade machines without the cost of purchasing new machines designed specifically for 16- or 20-ounce bottle dispensing. Furthermore, by eliminating the need to recover/scrap the components of the displaced machines, the present invention is believed to further reduce costs to those who own and operate vending equipment.

Heretofore, the following publication has disclosed aspects of a vending machine, the relevant portions of which may be briefly summarized as follows:

"Dixie-Narco Parts List; Most Ranson Built Models Made During the 1980's", No. 903901960.01, (Dec. 1, 1987), hereby incorporated in its entirety by reference, teaches various components and parts in a can vending machine, including cabinet and vend mechanisms to which aspects of the present invention are directed.

In accordance with the present invention, there is provided a beverage vending machine for dispensing beverages in containers, comprising: a housing including an upper interior cabinet and a lower interior cabinet, wherein the upper interior cabinet may be refrigerated; a main door hingedly attached to said housing, the main door having a main door assembly therein for advertising the beverages, the main door assembly also including a plurality of user-activated switches for beverage selection in conjunction with the receipt of money inserted into the machine; said upper interior cabinet having a vend mechanism inserted therein, where said vend mechanism includes a plurality of racks positioned so as to allow the insertion of at least a stack of 16- or 20-ounce bottles therein, and an automated vending assembly for dispensing bottles from the bottom of said stack, in response to the user's selection, into a chute for delivery through the main door of the machine; and wherein the vend mechanism includes a plurality of spaced apart vertical side members defining the racks, said vertical side members being spaced in accordance with predefined spacing on a plurality of horizontal members, said spacing being defined as a function of the size of the containers and the inside width of the upper interior cabinet.

In accordance with another aspect of the present invention, there is provided a beverage container vending machine conversion kit, for converting a can vending machine having a housing including an upper interior cabinet and a lower interior cabinet, wherein the upper interior cabinet may be refrigerated, a main door with a plurality of user-activated switches for beverage selection in conjunction with the receipt of money inserted into the machine, where the upper interior cabinet has a vend mechanism inserted therein and includes a plurality of vertical side members positioned so as to allow the insertion of cans for dispensing from the bottom of a stack into a chute in response to a user's selection, comprising: a front offset plate; a rear offset plate; a Z-shaped rear plate; a U-shaped front cutout bracket; and a U-shaped sensor bracket, wherein each of said components includes pre-drilled holes for aligning the plurality of vertical supports in a spaced-apart manner at a distance defined as a function of the size of bottles to be inserted therein and the inside width of the upper interior cabinet.

In accordance with yet another aspect of the present invention, there is provided a method for converting a beverage can vending machine to a bottle vending machine, comprising the steps of: opening the front door of the vending machine to reveal an upper interior cabinet and removing a welded gate assembly from a vend mechanism and a can rack therein; removing all covers from vend motors and sold out switches within the can rack, and removing a chute assembly from the vend mechanism; disconnecting wires from vend motors and sold out switches and tuck the wires out of the way in a lower cabinet; removing the vend motors and setting them aside; removing rear can supports from the can rack; removing bolts that hold a can rack within the upper interior cabinet; removing the can rack from the upper interior cabinet by sliding it forward and lifting it out of the upper interior cabinet; disassembling the can rack; removing can shims from the can rack and any associated shim holders; drilling out all rivets in narrow column gate assembly within the can rack and removing all sold out paddle assemblies at each can rack column and all rotors and oscillators; drilling out all rivets that hold the can rack assembly together and setting the vertical supports aside; taking at least one vertical support in the can rack assembly and removing the sheet metal assembly riveted to the front of the vertical support; folding the front edge of the vertical support down with a heavy-duty sheet metal brake, to match other narrow column supports; placing the modified vertical support back with the other vertical supports; using fasteners fastening a U-shaped front bracket and Z-shaped rear plate into place to hold bottom comers of the vertical supports, and fastening a front offset plate and a rear offset plate into place to hold top corners of the vertical supports to create a bottle rack; removing springs, switches and paddle switch assembly from an old bracket and reinstalling the same on a U-shaped sold-out sensor bracket; installing the U-shaped sold-out sensor bracket on the bottle rack at a position near the bottom of the bottle rack; installing the rotors and oscillators into the bottle rack; reinstalling the bottle rack into the upper interior cabinet; reinstalling the vend motors and hooking up wires (previously removed) for vend motors and sold out switches; reinstalling the chute assembly; removing any obstruction to bottle being vended through the front door, and flipping over discharge member so half moon cut out is on top.

One aspect of the invention deals with a basic problem in the refurbishing, recycling and disposal of vending equipment—the need to frequently update or replace such equipment when product packaging is changed or modified (e.g., size or shape of packaging such as a change from 12-ounce cans to 16- or 20-ounce bottles). This aspect is further based on the discovery of a technique that alleviates this problem. The technique utilizes the essential components of an existing machine, modifying only a few parts, so as to allow a beverage vending machine to be changed from can to bottle vending with only a reasonable amount of effort. In this way, vendors are able to have their machines refurbished rather than having to replace the old machines with costly new machines.

The techniques and aspects of the invention described herein are advantageous because they are both straightforward and inexpensive compared to other approaches, and make it unnecessary to completely scrap older yet functional vending machines. As a result of the invention, conventional can vending machines may be easily modified to allow the machines to vend newer, larger bottles—thereby saving the vendor from the expense of having to replace can vending machines.

Figure 1:
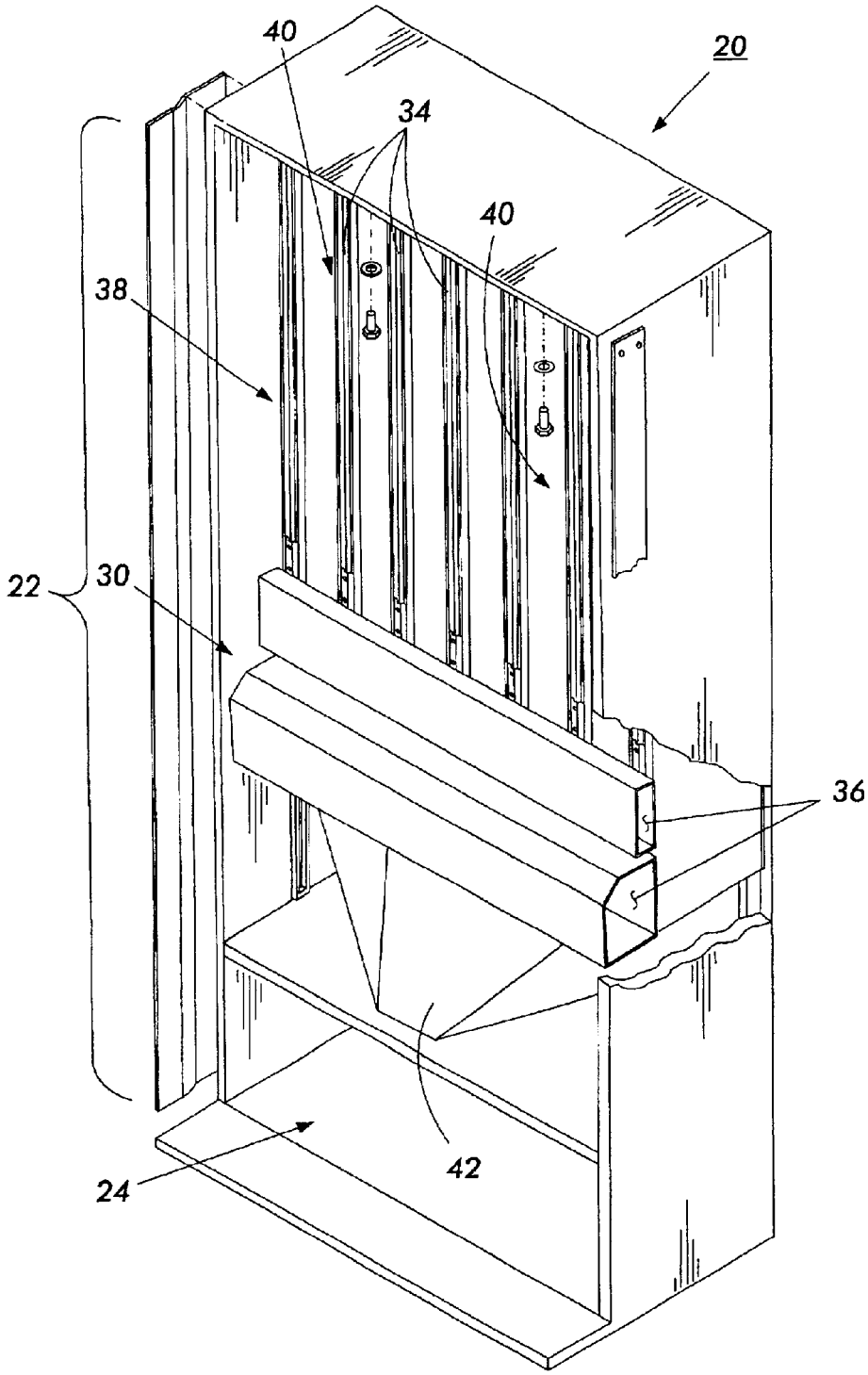
FIG. 1 PRIOR ART
FIG. 1 Is a perspective view of a prior art vending machine for cans.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements, In describing the present invention, the following term(s) have been used to describe the vending machines. An "upper interior cabinet" is an open region, generally including the upper portion of the vending machine, where apparatus to store and dispense goods are located. In beverage vending machines, the upper interior cabinet is often refrigerated. A "vend mechanism" or "vend mechanism assembly" is an assembly, generally inserted or located within the upper interior cabinet, that controls the advancement and dispensing of goods from the vending machine. In a beverage vending machine, the vend mechanism generally includes a rack (bottles or cans) or similar storage mechanism for storing the beverage containers, dispensing devices to control the dispensing of containers into a chute located at the bottom of the vend mechanism.

The present invention, as an apparatus and method for the refurbishment and reconfiguration of a beverage can vending machine, is particularly directed to machines designed to dispense cans, where the machine can be made to dispense bottles. Accordingly, an embodiment of the present invention is particularly directed toward existing beverage can vending equipment such as equipment produced by Dixie-Narco, Inc. (a Maytag Company) of Williston, S.C. More specifically, an embodiment of the present invention is designed for use in the "Ranson Built Models" of can vending machines as represented, for example, in FIG. 1 and as further described in detail in the "Dixie-Narco Parts List; Most Ranson Built Models Made During the 1980's", No. 903901960.01, (Dec. 1, 1987), previously incorporated by reference in its entirety. Referring to prior art FIG. 1, there is illustrated a perspective view of an interior cabinet or housing and vend mechanism for a typical can vending machine. The cabinet, as is well known in the trade is located behind a main door of the vending machine (not shown). In particular, the interior cabinet 20 includes an upper interior cabinet region 22 and a lower interior cabinet 24 that generally houses a refrigeration unit (not shown) for the upper interior cabinet region. Within the upper interior cabinet is a vend mechanism or assembly 30 that both stores and controls the dispending of cans in response to a user inserting money and making a selection of the desired beverage type via switches and a coin/bill receiver on the front door.

Vend mechanism 30 further includes a plurality of vertical supports or can guides 34, that are held in relation to one another using various horizontally oriented brackets or channels 36 (and others not shown) that are generally affixed to the supports using rivets or similar fasteners. In combination, the vertical supports and associated channels form a prior art can rack 38 with a plurality of spaced-apart areas 40 for the insertion of cans therein for dispensing out the bottom of the rack into a chute 42 that may be accessed via an opening in the front door.

Figure 2:
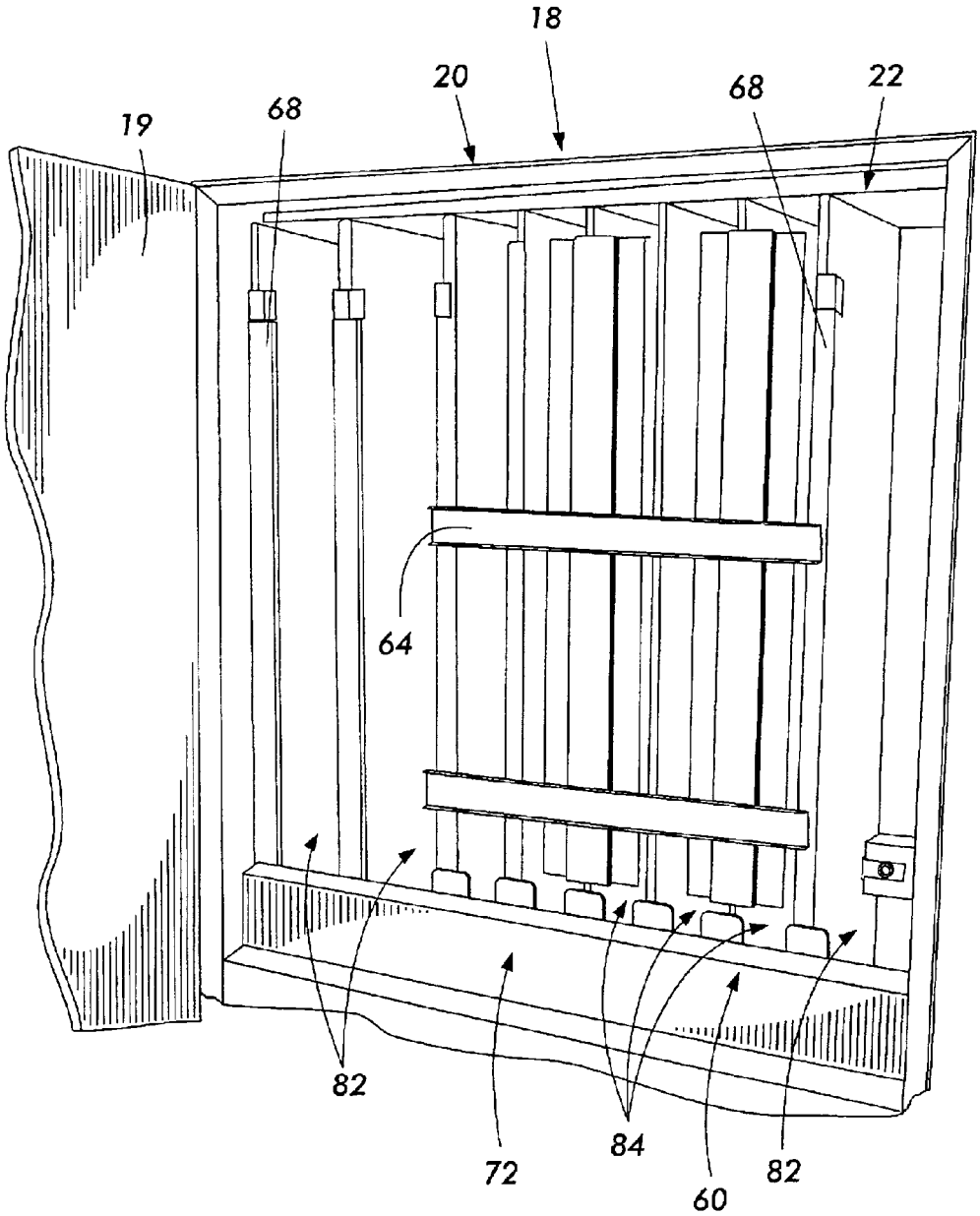
FIGS. 2 and 3 are perspective views of the vend cabinet region of a modified vending machine in accordance with the present invention.
Figure 3:
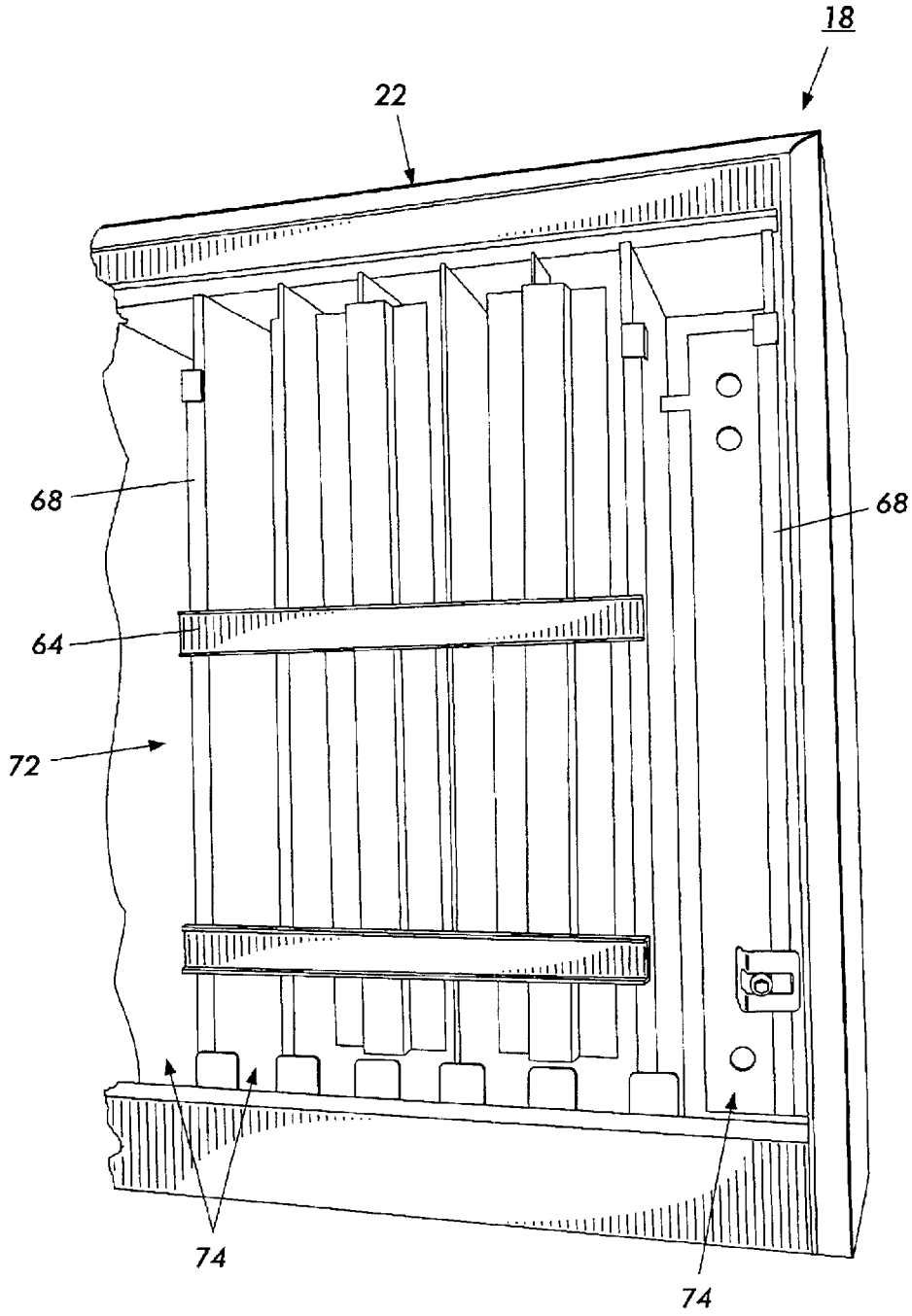

Referring next to FIG. 2, there is depicted an embodiment of the machine 18 described in FIG. 1 with the front door 19 opened. The improved, reworked vend mechanism 60 is shown which enables the storage and dispensing of bottles from the machine. Referring also to FIG. 3, which is a close-up view of the reworked bottle vend mechanism 60 installed within upper interior cabinet 22, bottles (not shown) are preferably held within the rack using a welded gate assembly 64 that is opened to re-supply the bottles in the rack or to service the rack as will be further described herein. In the embodiment of FIGS. 2 and 3, the beverage vending machine, for dispensing beverages in bottles, as retrofitted or refurbished from a can vending machine, includes the housing or cabinet 20 an upper interior cabinet 22 and a lower interior cabinet (not shown), wherein the upper interior cabinet may be refrigerated so as to provide cooled beverages in bottles. The main door 19 is, in most cases, hingedly attached to the housing and has main door assembly therein for advertising the beverages along with a plurality of user-activated switches for beverage selection in conjunction with the insertion of money into the machine.

Figure 4:
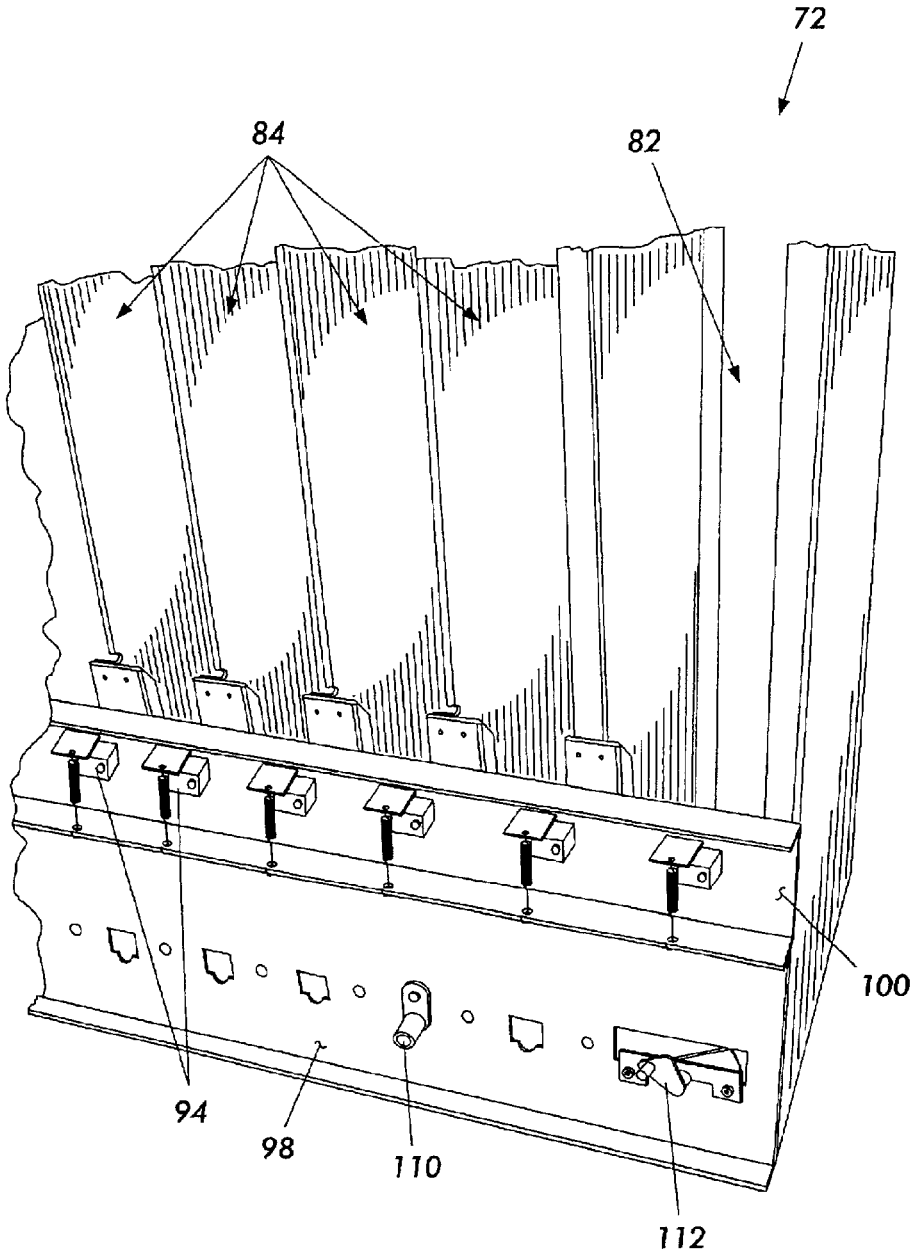
FIG. 4 is a close-up view of a portion of a modified can rack, holding bottles therein, in accordance with the present invention.

As illustrated in the figures, the upper interior cabinet has the vend mechanism assembly inserted into it, and the vend mechanism includes two end supports 68 and seven interior vertical supports 70 that form rack 72 with compartments 74 positioned so as to allow the insertion of at least a single-wide stack of 16- or 20-ounce bottles therein. It will be appreciated that the end compartments, or other compartments, of the rack 72 are slightly wider to allow an offset stack of bottles to be stored therein as depicted in FIG. 4, and thereby increase the space usage of the compartment—preferably for higher demand beverages. At the lower end of the rack 72 is located and an automated, gravity fed vending assembly for dispensing bottles from the bottom of a stack, into a chute (not shown) for delivery through the main door of the machine in response to the user's insertion of money and making a selection of the beverage type desired.

In particular, the vend mechanism includes a plurality of spaced apart vertical support members defining the rack or compartments that feed into a chute. Because the rack is formed primarily from pre-existing components that are available in a can dispensing machine that is to be refurbished, the various components of the can dispensing machine are intentionally reused to the extent possible. However, as the 16- or 20-ounce bottles are of a wider diameter than cans, and are also longer, the present invention is directed toward the efficient reworking of the can rack components so as to produce the bottle rack 72 of FIGS. 2 and 3. In particular, the various horizontal members of the bottle rack 72 are preferably spaced in accordance with predefined spacing. Although the spacing may be modified to various configurations, the present invention intends to produce a bottle rack with three high-capacity bottle storage compartments 82 and five low-capacity compartments 84. This configuration optimizes the number of bottles that may be stored within the converted can vending equipment. Hence, the spacing between the various vertical supports is a function of the size of the containers (bottles) to be dispensed and the inside width of the upper interior cabinet into which the rack is inserted.

Figure 5:
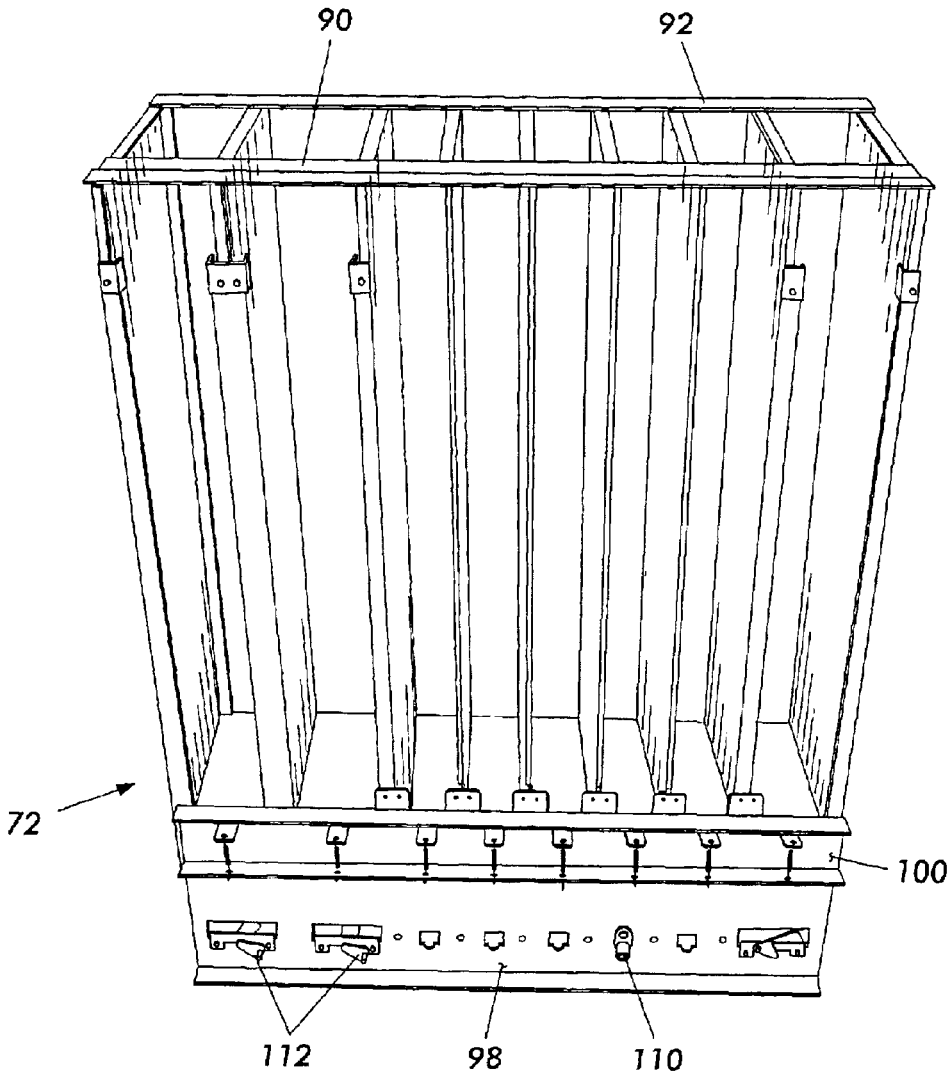
FIGS. 5 and 6 are alternative views of the rack of FIG. 4.
Figure 6:
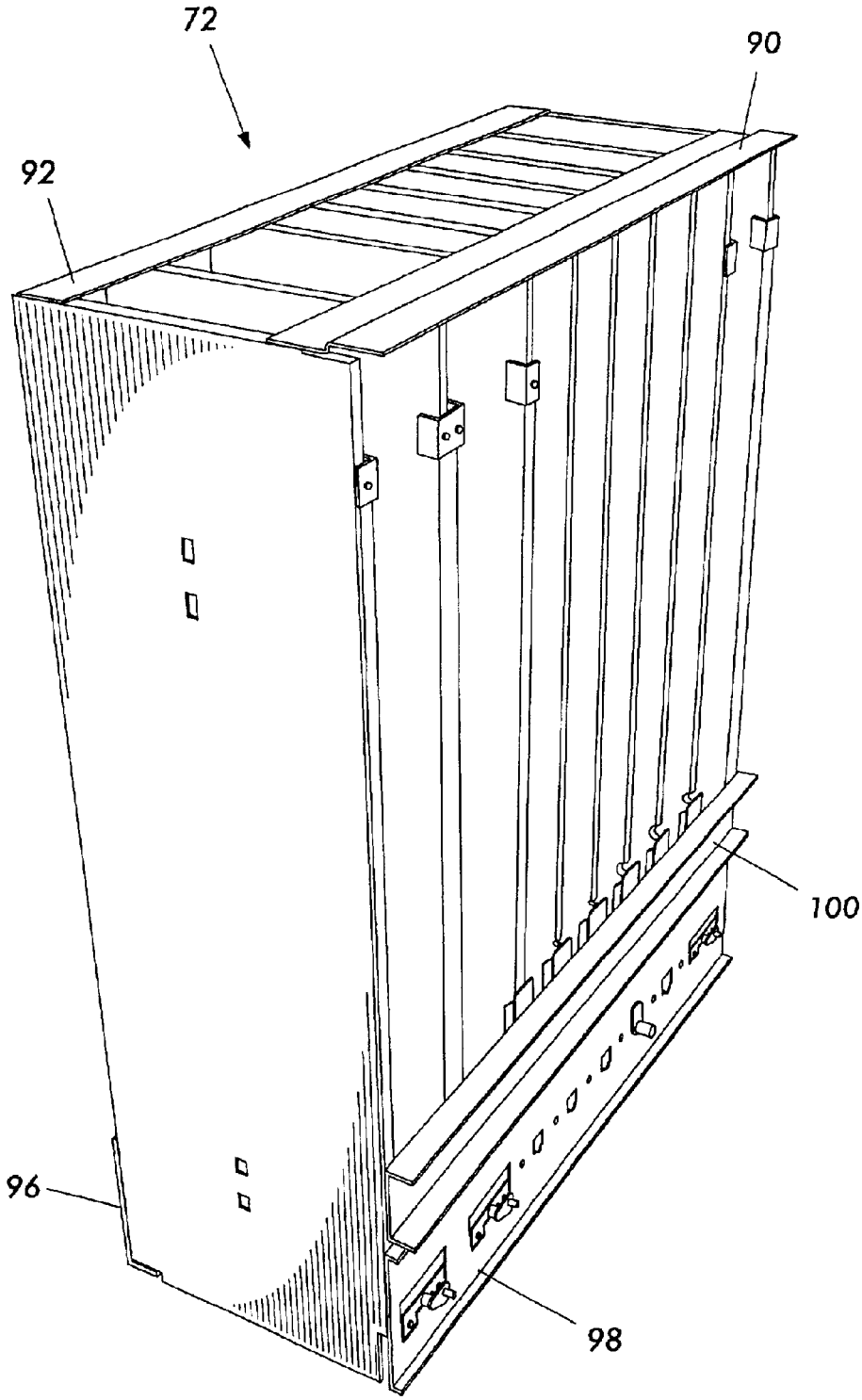

Referring next to FIGS. 5 and 6, in conjunction with FIG. 4, further details of the bottle rack will be described. In particular, as noted above, the end and interior vertical supports of the rack are held in a spaced-apart relationship by various horizontal members, including a front offset plate 90, a rear offset plate 92, a Z-shaped rear plate 96, and a U-shaped front cutout bracket 98. The various plates and brackets each have pre-drilled holes therein that correspond with the desired location of the vertical supports and/or hardware on the vertical supports. In the embodiment depicted in the figures, an additional horizontal member, a U-shaped sensor bracket 100 is also attached to the face of the rack. The sensor bracket houses and provides mounting for sensors that include mechanical switches attached to paddles, where the switches cause a signal to indicate that no bottles remain in a particular compartment, thereby preventing a further dispense cycle and showing an "empty" indication on the selection button on the face of the machine (not shown). The sensor switches and paddle assemblies are well-known (e.g., Dixie-Narco Part Nos. 804,100,560.01 Switch, Sold Out, 900,301,670.01 Screw, Sold Out Switch #4×1¼", C231,070,1 70.43 Paddle, Sold Out, 901,700, 630.01 Spring, Sold Out Paddle, and 801,804, 350.01Insulator, Switch), but have been repositioned using the U-shaped sensor bracket 100 so as to allow the paddles to be aligned with the repositioned compartments of the reconfigured bottle rack.

Figure 7:
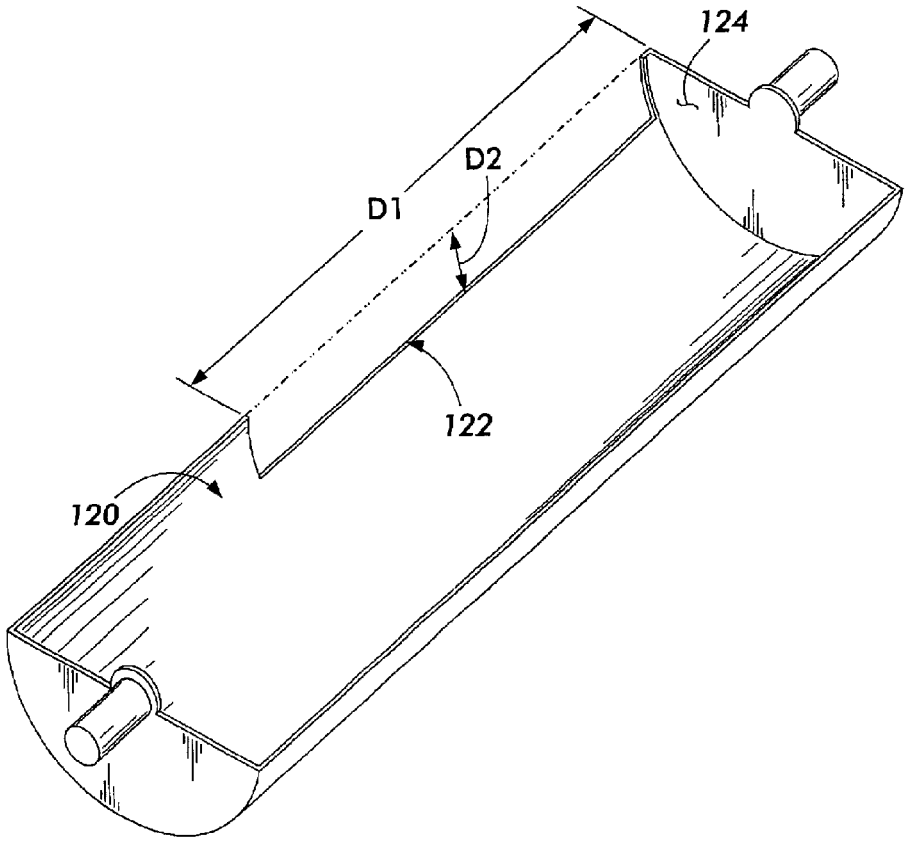
FIG. 7 is a perspective view of a modified rotor in accordance with an aspect of the present invention.

At the bottom of the rack 72 is located the vending or dispensing mechanism associated with each bottle compartment 82, 84. In the embodiment depicted, the vend mechanisms are similar in design to those employed in the conventional can vending machines. For example, as seen on the face of the U-shaped front cutout bracket 98 in the figures is a vend rotor or oscillator assembly 110, 112 (e.g., Dixie-Narco Part No. C231,070,400.3 or 179,070,600.33) that would be attached to a vend motor (not shown), the type being dependent upon the width of the compartment. In a single bottle compartment 84, the rotor is preferably a half-cylinder shaped device such as depicted in FIG. 7, which supports a bottle therein and prevents the next bottle above from dropping as it rotates to allow the bottle therein to be dispensed into the chute. For the wide staggered stack 82, the oscillator is similar to that of Dixie-Narco No. D801,201,010.01 or D801,201,000.01, where the fact that bottles are stacked on top of one another allows the open-type oscillator design to be used.

Referring briefly to FIG. 7, depicted therein is a perspective view of a modified can dispensing rotor 120 for use in single bottle compartments, where the top, offset bottle must be held from dispensing while the bottom bottle is dispensed into the chute. The rotor 120 is modified, in accordance with an aspect of the present invention to allow the can-size rotor to work with bottles. In particular, a notch 122 is cut in the side of the rotor to enable it to hold a standard 16- or 20-ounce bottle therein, and to rotate to dispense the bottle. Notch 122 extends a distance D1 from the front end 124 of the rotor, where the distance D1 is approximately 8.250 inches. The notch also has a depth D2, at its maximum, of approximately 1.00 inches. The notch, in particular, allows the rotor to accept the bottle, and a shoulder thereof fully within the rotor, and enables the reuse of the can-type rotor without the need to redesign or purchase new rotors, thereby saving money in the conversion of a can-type vending machine to bottle vending.

Having briefly described the various components of the present invention, attention is now turned to FIGS. 8–12, where particular details of the components that are added or replaced in the can-type rack are described. In one embodiment, the present invention may be implemented and sold in the form of a refurbishing "kit" or similar means. The beverage container vending machine conversion kit, for example, may be made for converting a can vending machine having a housing including an upper interior cabinet and a lower interior cabinet, so as to allow the insertion of 16 or 20-ounce bottles for dispensing from the bottom of the stack into a chute in response to a user's selection. As noted previously, each of the horizontal rack components in the kit preferably includes pre-drilled holes for aligning the vertical supports in a spaced-apart manner at a predefined distance. The separation distance of the supports is preferably a function of the size of the bottles to be inserted therein, the number and type (single-file or staggered) of compartments, and the inside width of the upper interior cabinet.

Figure 8:
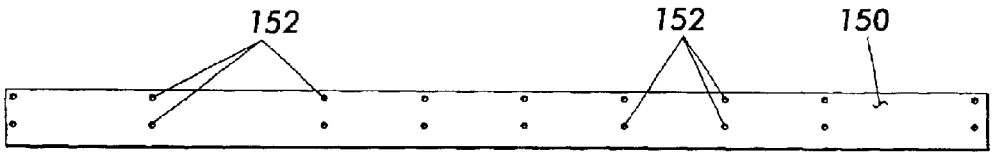
FIGS. 8–12 are orthographic views of particular embodiments of components used in the conversion aspects of the present invention.
Figure 9:
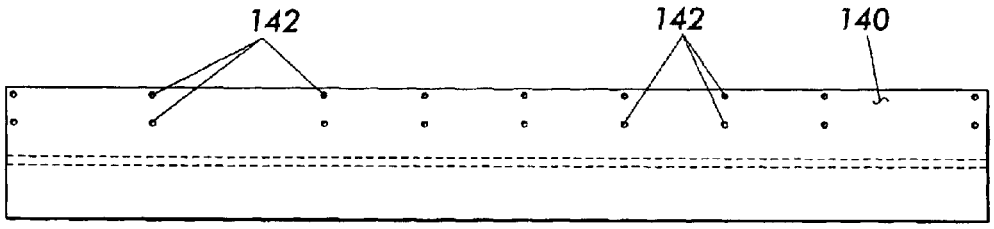

As illustrated in FIGS. 8–9, the top front and rear offset plates, 140 and 150, are employed near the top corners of the vertical supports to hold the supports at the predetermined spacing—where the compartments are designed to hold bottles in single-file or staggered configuration. As illustrated in the figures, the plates include a plurality of holes 142 and 152 that enable the plates to be fastened to the tops of the vertical support members, using fasteners such as pop-rivets, screws or other equivalent mechanisms. In one embodiment, the single-file compartments include supports spaced at approximately at least 3.25 inches. Alternatively, spacing between at least two vertical supports, one of which may be an end support, is at least 5.5 inches to accommodate staggered stack of 16- or 20-ounce bottles.

Figure 10:
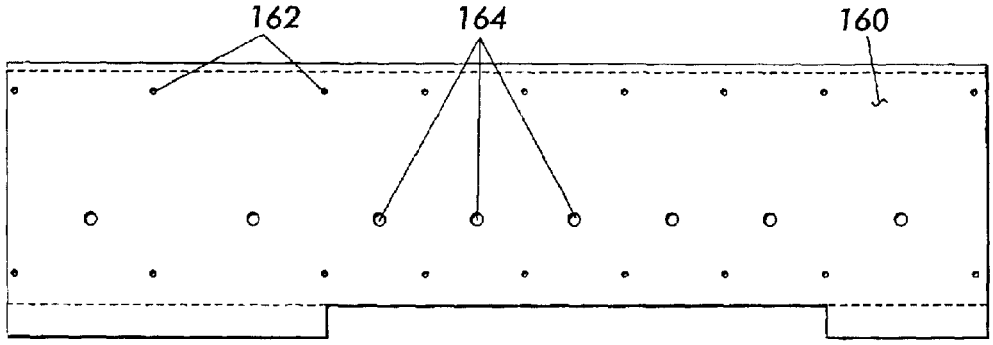
Figure 11:
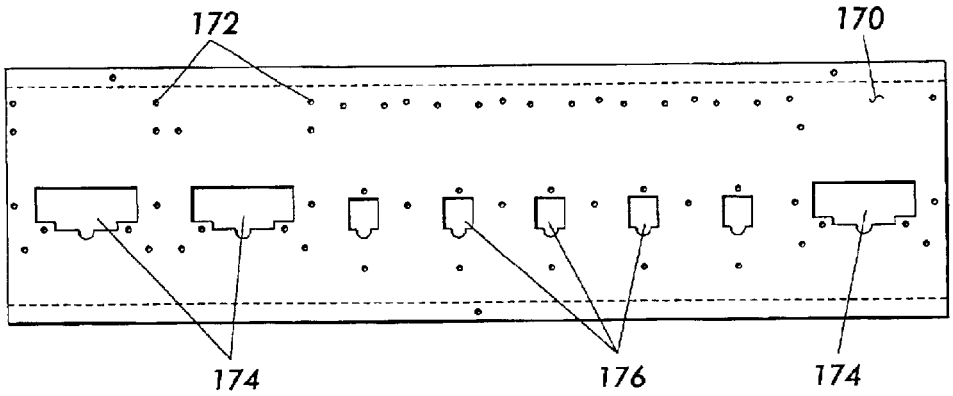

Referring next to FIG. 10, depicted therein is a plan view of the bottom rear Z-plate which holds the lower, inboard ends of the vertical support members in the bottle rack. The Z-plate 160 also includes holes 162 by which the vertical supports are fastened thereto, as well as a series of larger diameter holes 164 that correspond with the approximate center of each compartment so as to allow for the insertion of a shaft on the inboard end of a rotor or oscillator for bottle dispensing. When used in conjunction with the U-shaped cutout bracket 170 of FIG. 11, which includes support mounting holes 172 and vend motor mounting cutouts 174, 176, for installation of the conventional vend motors and associated rotors and oscillators therein. Once inserted and mounted to the cutout bracket 170, the vend motors will hold the respective rotors and oscillators at the bottoms of each of the respective compartments in order to limit the dispensing of the bottles (e.g., bottles in FIG. 5). It will be appreciated that bottle guides (e.g., Dixie-Narco Nos. C267,070,200.03 or C267,070,300.03) would be used in-between the vertical supports, to keep the bottles in the stack.

Figure 12:
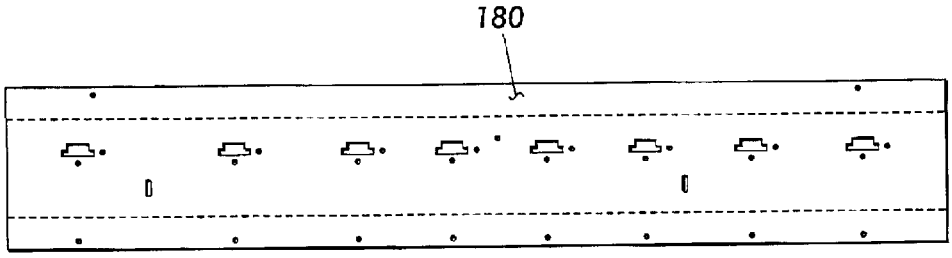

A final component that must be included in order to allow the can rack to be converted a functional bottle rack in a bottle vending assembly is the U-shaped sensor bracket 180 shown in FIG. 12. This bracket, as briefly described above, is affixed to the rack at a position near the bottom of the rack and holds a plurality of switches 94 (FIG. 4) and associated paddles to sense the presence of bottles in the vertical compartments. When no bottles are present, or after the last bottle has passed to the dispensing rotor/oscillator, the switch causes a signal that will put the machine in a condition to signal that the compartment is empty. Here again, the spacing of the switch mounting holes 184 is determined as a function of the location of the vertical supports so as to position the paddles in approximately the center of each compartment, and at a height suitable to sense the dispensing of the last or second to last bottle.

In an alternative embodiment contemplated in accordance with the present invention it may be possible to combine, into a common component, the two U-shaped brackets may be combined into a common unit. More specifically, a single part, with particular mounting holes, tabs, folds, etc. may be formed to serve the purpose of the U-shaped cutout bracket 170 and U-shaped sensor bracket 180.

Figure 13:
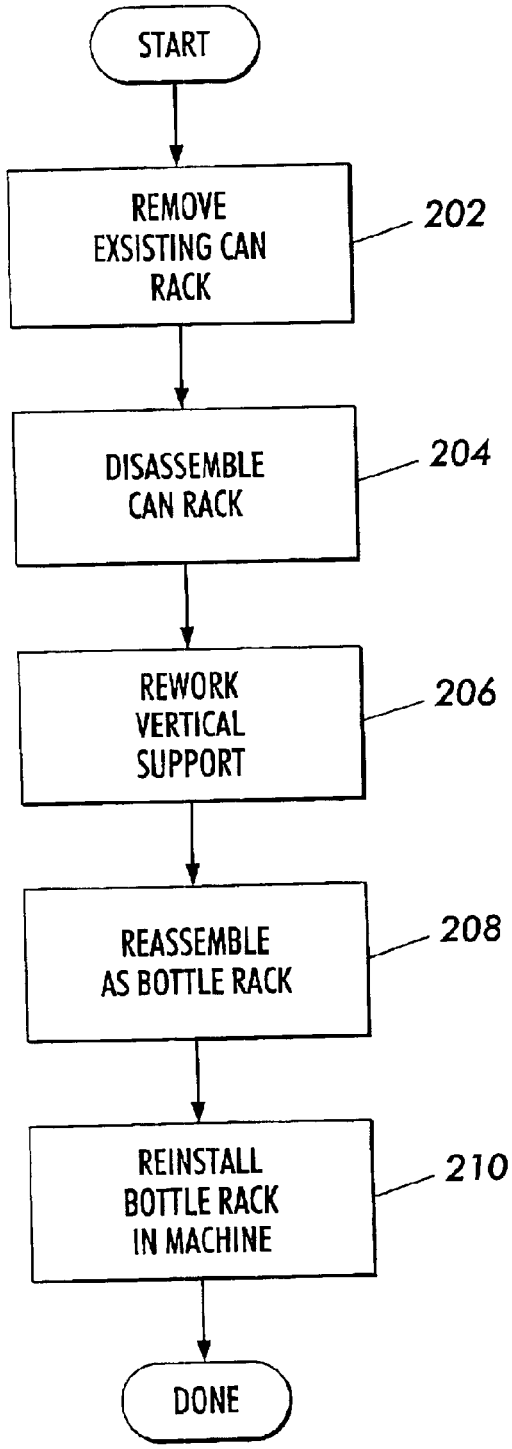
FIG. 13 is a simplified block diagram illustrating the general steps performed in the process of converting a can-type vending machine to a bottle-type vending machine in accordance with the present invention.

Having described the present invention in the nature of the modifications made for refurbishment of a can-type vending machine to provide a bottle-type vending machine with minimal modification, attention is now turned to the method for accomplishing such refurbishment. In particular, referring to FIG. 13, the method of refurbishment is generally indicated by the steps depicted therein and as more specifically described below.

The process is initiated with the step of removing the can rack from the existing machine, step 202, including opening the front door of the vending machine to reveal an upper interior cabinet and removing the welded gate assembly from the vend mechanism therein. Next, removing all covers from the vend motors and sold out switches within the vend mechanism. The chute assembly must also be removed from the vend mechanism, and all wires must be disconnected from vend motors and sold out switches. During the refurbishing operation, the wires (wiring harness ends) are preferably tucked out of the way in the lower refrigeration cabinet. Prior to removing the rack, it is preferable to remove the vend motors and rear can supports from the vend mechanism and set them aside. Next, it will be necessary to remove the bolts or other fasteners that hold the can rack within the upper interior is cabinet and finally to remove the can rack from the upper interior cabinet by sliding it forward and lifting it out of the cabinet to complete step 202.

Step 204, then is directed to the disassembly of the removed can rack. Here it is noted that care should be taken not to change or mix up the rack vertical supports as the order of the supports is somewhat critical to completing the refurbishment in accordance with the particular configuration of the rack as depicted in FIGS. 2–6. Next, the can shims should be removed from the lower end of the can rack, as well as the two (2) metal shim holders (rods). Although not shown in the figures, the rods extend widthwise across the rack, are clipped on either end to hold them in the rack and they provide a means for holding the can or bottle shims. Once removed, the rack is further disassembled by drilling out all rivets in narrow column gate assembly within the can rack and removing, the sold out paddle assemblies at each can rack compartment or column as well as all rotors and oscillators. Subsequently, the disassembly continues with drilling out all rivets that hold the can rack assembly together and setting the vertical supports aside (maintaining their respective order).

Next, step 206, an optional step necessary to implement the refurbishing process from parts within an existing machine, includes taking at least one vertical support in the can rack assembly, preferably the second support from the right, and removing the sheet metal assembly riveted to the front of the vertical support. The support is then modified by folding the front edge of the vertical support down with a heavy-duty sheet metal brake, to match the general shape and configuration of the other existing narrow compartment supports. Step 206 is completed by placing the modified vertical support back with the other vertical supports, but preferably putting it third from the right. It will be appreciated that as an alternative to reworking the support, it is possible that the components or kit described above may include a new support or a similar vertical support from another machine.

Step 208, then, begins the process of reassembling the rack as a bottle storage and dispensing rack in accordance with the invention. Specifically, using fasteners such as 3/16" rivets, a U-shaped front bracket and Z-shaped rear plate are riveted into place to hold bottom corners of the vertical supports. Next, 1/8" rivets are used to fasten two top support brackets (offset front offset plate, rear offset Aplate) into place to hold the top comers of the vertical supports and to create the bottle rack as illustrated in FIG. 6, for example. The rack is then completed by adding the other components previously removed, including removing springs, switches and paddle switch assembly from the old bracket and reinstalling the same on the U-shaped sold-out sensor bracket. Next, the U-shaped sold-out sensor bracket is installed on the bottle rack at a position near the bottom of the bottle rack. The two metal shim holders (rods) are then reinstalled into the rack assembly and the rotors and oscillators are installed at the bottoms of each compartment or column in the bottle rack.

Lastly, the process is completed at step 210, where the bottle rack is reinstalled into the upper interior cabinet and the vend motors and control/power wiring is hooked up for the vend motors and sold out switches. The chute assembly may then be reinstalled and any obstruction to a bottle being vended through the front door should be removed before the rack is loaded. Note that it is also advisable to flip over the discharge member so half moon cut out is on top.

As noted above with respect to FIG. 7, the refurbishing process may also require modifying at least one rotor removed from the can rack to allow the rotor to be used for the dispensing of a bottle. The step of modifying at least one rotor includes cutting out a notch 122 in the side of the rotor to allow a bottle to fit therein.

In recapitulation, the present invention is a method and apparatus for the refurbishment of a beverage vending machine to enable a can vending machine to be reconfigured for the dispensing of bottles. In particular, the apparatus and process are directed to the modification of certain components of a can vending machine to enable it to be utilized for dispensing of newer, 16- or 20-ounce beverage bottles. The modification includes a change in the spacing and configuration of the container storage rack and the modification of dispensing mechanisms to allow a can-type system to dispense bottles and thereby avoid the need to completely replace the vending machine.

It is, therefore, apparent that there has been provided, in accordance with the present invention, a method and apparatus for refurbishing a vending machine. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A beverage vending machine for dispensing beverages in containers, comprising:

a housing including an upper interior cabinet and a lower interior cabinet, wherein the upper interior cabinet may be refrigerated;

a main door hingedly attached to said housing, the main door having a main door assembly therein for advertising the beverages, the main door assembly also including a plurality of user-activated switches for beverage selection in conjunction with the receipt of money inserted into the machine;

said upper interior cabinet having a vend mechanism inserted therein, where said vend mechanism includes a rack positioned so as to allow the insertion of at least a stack of bottles therein, and an automated vending assembly for dispensing bottles from the bottom of said stack, in response to the user's selection, into a chute for delivery through the main door of the machine;

wherein the vend mechanism includes a plurality of spaced apart vertical side members defining the rack, said vertical side members being spaced in accordance with predefined spacing on a plurality of horizontal members, said spacing being defined as a function of the size of the bottles and the inside width of the upper interior cabinet; and where said plurality of horizontal members includes, a front offset plate, a rear offset plate, a Z-shaped rear plate, and a U-shaped front cutout bracket.

2. The apparatus of claim 1, wherein said plurality of horizontal members further includes a U-shaped sensor bracket.

3. A beverage vending machine for dispensing beverages in containers, comprising:

a housing including an upper interior cabinet and a lower interior cabinet, wherein the upper interior cabinet may be refrigerated;

a main door hingedly attached to said housing, the main door having a main door assembly therein for advertising the beverages, the main door assembly also including a plurality of user-activated switches for beverage selection in conjunction with the receipt of money inserted into the machine;

said upper interior cabinet having a vend mechanism inserted therein, where said vend mechanism includes a rack positioned so as to allow the insertion of at least a stack of bottles therein, and an automated vending assembly for dispensing bottles from the bottom of said stack, in response to the user's selection, into a chute for delivery through the main door of the machine;

wherein the vend mechanism includes a plurality of spaced apart vertical side members defining the rack, said vertical side members being spaced in accordance with predefined spacing on a plurality of horizontal members, said spacing being defined as a function of the size of the bottles and the inside width of the upper interior cabinet; and a can dispensing rotor having a notch cut in one side thereof, wherein a location of the notch in said dispensing rotor is a function of bottle shape.

4. A beverage container vending machine conversion kit, for converting a can vending machine having a housing including an upper interior cabinet and a lower interior cabinet, wherein the upper interior cabinet may be refrigerated, a main door with a plurality of user-activated switches for beverage selection in conjunction with the receipt of money inserted into the machine, where the upper interior cabinet has a can rack inserted therein and includes a plurality of vertical side members positioned so as to allow the insertion of cans for dispensing from the bottom of a stack within the rack into a chute in response to a user's selection, comprising:

a front offset plate;

a rear offset plate;

a Z-shaped rear plate;

a U-shaped front cutout bracket; and a U-shaped sensor bracket, wherein each of said components includes pre-drilled holes for aligning the plurality of vertical supports in a spaced-apart manner at a distance defined as a function of the size of bottles to be inserted therein and the inside width of the upper interior cabinet.

5. The conversion kit of claim 4, wherein said distance is at least 3.25 inches.

6. The conversion kit of claim 5, wherein said distance between at least two vertical supports, one of which is an end support, is at least 5.5 inches.

7. The conversion kit of claim 4, further comprising a modified can dispensing rotor having a notch cut in one side thereof.

8. A method for converting a beverage can vending machine to a bottle vending machine, comprising the steps of.

opening the front door of the vending machine to reveal an upper interior cabinet and removing a welded gate assembly from a vend mechanism and a can rack therein;

removing all covers from vend motors and sold out switches within the can rack, and removing a chute assembly from the vend mechanism;

disconnecting wires from vend motors and sold out switches and tuck the wires out of the way in a lower cabinet;

removing the vend motors and setting them aside;

removing rear can supports from the can rack;

removing bolts that hold a can rack within the upper interior cabinet;

removing the can rack from the upper interior cabinet by sliding it forward and lifting it out of the upper interior cabinet;

disassembling the can rack;

removing can shims from the can rack and any associated shim holders;

drilling out all rivets in narrow column gate assembly within the can rack and removing all sold out paddle assemblies at each can rack column and all rotors and oscillators;

drilling out all rivets that hold the can rack assembly together and setting the vertical supports aside;

taking at least one vertical support in the can rack assembly and removing the sheet metal assembly riveted to the front of the vertical support;

folding the front edge of the vertical support down with a heavy-duty sheet metal brake, to match other narrow column supports;

placing the modified vertical support back with the other vertical supports;

using fasteners fastening a U-shaped front bracket and Z-shaped rear plate into place to hold bottom comers of the vertical supports, and fastening a front offset plate and a rear offset plate into place to hold top comers of the vertical supports to create a bottle rack;

removing springs, switches and paddle switch assembly from an old bracket and reinstalling the same on a U-shaped sold-out sensor bracket;

installing the U-shaped sell-out sensor bracket on the bottle rack at a position near the bottom of the bottle rack;

installing the rotors and oscillators into the bottle rack;

reinstalling the bottle rack into the upper interior cabinet;

reinstalling the vend motors and hooking up wires (previously removed) for vend motors and sold out switches;

reinstalling the chute assembly;

removing any obstruction to bottle being vended through the front door; and flipping over discharge member so half moon cut out is on top.

9. The method of claim 8, wherein the step of removing bolts that hold a can rack within the upper interior cabinet comprises:

removing bolts located in a second column from each end behind the rear can supports; and removing bolts located at a top and front of the can rack.

10. The method of claim 8, further comprising the step of modifying at least one rotor removed from the can rack to allow the rotor to be used for the dispensing of a bottle.

11. The method of claim 10, wherein the step of modifying at least one rotor includes cutting out a notch in the side of the rotor to allow a bottle to fit therein.

12. The method of claim 8, wherein the step of placing the modified vertical support back with the other vertical supports, places the modified vertical support in a position that is a third position from the end.

13. An adjustable vending device, for use in a beverage vending machine for dispensing beverage bottles stored in an interior cabinet thereof, comprising:

a rack positioned so as to allow the insertion of at least a stack of bottles therein, said rack including a plurality of spaced apart vertical side members defining the rack, said vertical side members being spaced in accordance with predefined spacing on a plurality of horizontal members, said spacing being defined as a function of the size of the bottles and the inside width of the interior cabinet; and a vending assembly for dispensing bottles from the bottom of said stack into a chute for delivery in response to a user's selection, said vending assembly including a dispensing rotor having a notch cut in at least one side thereof, wherein a location of the notch in said dispensing rotor is a function of bottle shape.

14. The adjustable vending device of claim 13, wherein the spacing of said vertical side members is adjustable.

15. The apparatus of claim 13, wherein said plurality of horizontal members includes:

a front offset plate;

a rear offset plate;

a Z-shaped rear plate; and a U-shaped front cutout bracket.

16. The apparatus of claim 15, wherein said plurality of horizontal members further includes a U-shaped sensor bracket.

* * * * *